US007131788B2

(12) United States Patent
Ianniello et al.

(10) Patent No.: US 7,131,788 B2
(45) Date of Patent: Nov. 7, 2006

(54) HIGH-FLOW VOID-MAINTAINING MEMBRANE LAMINATES, GRIDS AND METHODS

(75) Inventors: Peter J. Ianniello, Havre De Grace, MD (US); Aigen Zhao, Clarksville, MD (US); Gary L. Shaffer, Alexandria, VA (US)

(73) Assignee: Advanced Geotech Systems, Baltimore, MD (US)

( * ) Notice: Subject to any disclaimer, the term of this patent is extended or adjusted under 35 U.S.C. 154(b) by 0 days.

(21) Appl. No.: 10/691,975

(22) Filed: Oct. 24, 2003

(65) Prior Publication Data

US 2004/0131423 A1 Jul. 8, 2004

Related U.S. Application Data

(63) Continuation-in-part of application No. 10/232,811, filed on Sep. 3, 2002, now Pat. No. 6,802,669, and a continuation-in-part of application No. 09/501,324, filed on Feb. 10, 2000, now Pat. No. 6,505,996, and a continuation-in-part of application No. 09/501,318, filed on Feb. 10, 2000, now abandoned.

(60) Provisional application No. 60/476,230, filed on Jun. 6, 2003, provisional application No. 60/446,988, filed on Feb. 13, 2003, provisional application No. 60/316,036, filed on Aug. 31, 2001.

(51) Int. Cl.
*E01C 3/06* (2006.01)

(52) U.S. Cl. ..... 405/50; 405/302.7; 404/28; 404/31

(58) Field of Classification Search ..... 405/36–39, 405/42–51; 404/18, 27, 28, 31, 82; 52/169.5
See application file for complete search history.

(56) References Cited

U.S. PATENT DOCUMENTS 3,795,180 A * 3/1974 Larsen ..... 405/36
4,572,700 A * 2/1986 Mantarro et al. ..... 404/35
4,574,541 A * 3/1986 Raidt et al. ..... 52/169.5
4,730,953 A * 3/1988 Tarko ..... 405/45
4,733,989 A * 3/1988 Harriett ..... 405/43
4,815,892 A * 3/1989 Martin ..... 405/45
4,840,515 A * 6/1989 Freese ..... 405/45
4,943,185 A * 7/1990 McGuckin et al. ..... 405/45
5,263,792 A * 11/1993 Davis et al. ..... 405/45
5,692,348 A * 12/1997 Ambrosino ..... 52/169.5
5,823,706 A * 10/1998 Hoare et al. ..... 404/28
5,916,104 A * 6/1999 Lucenet et al. ..... 52/791.1
6,241,421 B1 * 6/2001 Harvie et al. ..... 405/45
6,691,472 B1 * 2/2004 Hubert ..... 52/169.5
6,736,569 B1 * 5/2004 Lee ..... 405/50
6,786,013 B1 * 9/2004 Coulton ..... 52/198
2001/0002497 A1 * 6/2001 Scuero ..... 14/73

(Continued)

FOREIGN PATENT DOCUMENTS

GB 2056236 A * 3/1981

*Primary Examiner*—Thomas B. Will
*Assistant Examiner*—Alexandra Pechhold
(74) *Attorney, Agent, or Firm*—Nath & Associates PLLC

(57) ABSTRACT

A myriad of permutations of void-maintaining membrane laminates are provided. Laminates of the invention are particularly useful for providing high performance drainage within layered paved structures such as highways, airport runways and parking lots. Void-maintaining laminates of the invention comprise compression elements that are shaped, adapted and arranged to cooperate with base and upper layers such that superior flow capacities are attained through their void spaces, channels and paths, even under pressures in excess of 5,000 lbs per square inch.

78 Claims, 7 Drawing Sheets

U.S. PATENT DOCUMENTS

2003/0118404 A1* 6/2003 Lee ..... 405/43

2003/0156905 A1* 8/2003 Hubert ..... 405/229

* cited by examiner

HIGH-FLOW VOID-MAINTAINING MEMBRANE LAMINATES, GRIDS AND METHODS

CROSS-REFERENCE TO RELATED APPLICATIONS

The present application is a Continuation-In-Part of U.S. application Ser. No. 10/232,811, filed Sep. 3, 2002 now U.S. Pat. No. 6,802,669 from U.S. Provisional 60/316,036 and others. application Ser. No. 10/232,811 is a Continuation-In-Part of U.S. patent application Ser. No. 09/501,324, now U.S. Pat. No. 6,505,996 and Ser. No. 09/501,318, now abandon both filed Feb. 10, 2000. The present application contains subject matter from U.S. Provisional Application No. 60/446,988, filed Feb. 13, 2003, and U.S. Provisional Application No. 60/476,230, filed Jun. 6, 2003. The cited Applications are hereby incorporated by reference and the benefits of their respective filing dates are hereby claimed.

FIELD OF THE INVENTION

The present invention pertains to means and methods for extending the life of paved structures such as highways and airport runways by providing improved and novel drainage geocomposites comprising primarily void-maintaining geosynthetic membrane laminates that can be installed economically with conventional road building and construction equipment.

BACKGROUND OF THE INVENTION

Water is a principal cause of distress and damage to paved structures such as roadways, airport runways and parking lots. Therefore, drainage systems are often provided in such structures in order to remove water from the paved surface or its foundations to thereby extend the useful life of the pavement surface. In some drainage methods, drainage systems are incorporated between the native soils or "subgrade" upon which a roadway or other large structure is situated and the overlying pavement surfaces. The present invention relates generally to synthetic void-maintaining structures with high permittivity and high transmissivity that are capable of extending the life of pavement by maintaining voids of sufficient dimensions to permit the timely egress of undesirable fluids, especially aqueous fluids.

In conventional road building, natural stone and aggregate materials are placed to form a drainable layer that is commonly called an Open Graded Base Course, or "OGBC." OGBC's are typically used underneath the surfaces of highways, airport runways, roads, and parking lots that are paved with bituminous materials such as asphalt or cementitious materials such as concrete. The present invention provides a series of high-flow void-maintaining membrane laminate ("VMML's") of polymeric material and related methods for economically manufacturing such laminates such that the need for an OGBC can be eliminated or minimized.

Pavement surfaces are highly engineered layered structures. Because of this, pavement structures require engineered materials that are selected based upon factors such as their density, particle or aggregate size, compressibility or other engineering parameters of the soil, stone and aggregate-based products that are required as structural fill that typically is installed in layers beneath pavement surfaces.

Two types of structural fill are the base course and, typically immediately beneath the base course, a sub-base course. Fluids such as water that become trapped or retained within structural fill cause damage to roadways and, over time, subsequently greatly reduce the useful life of a pavement system. These destructive phenomena occur even when asphalt additives, waterproofing techniques and conventional geosynthetics are used to improve the road.

The cause of many premature pavement failures has been traced to inadequate subsurface drainage. Typically, fluids enter the subsurface layers of pavement systems from surface infiltration through joints and cracks in the pavement, as well as pores in the pavement itself, seepage from the sides of the paved surface, and from rising groundwater beneath the road surface, either by capillary action or the upward movement of water in vapor form. In fact, the FHWA discovered that over 50% of all rainfall reaching a mature pavement surface enters underlying structural portions of the pavement through infiltration. In northern tier states, the destructive nature of water trapped in the structural base is exacerbated by freeze-thaw cycles, and particularly during spring thaw as ice lenses melt to create water-filled voids and very soft, water-saturated soils which lose a substantial amount of their compressive strength. In turn, these phenomena result in extensive damage to the highway system. These and related drainage-based structural issues are now well-recognized in the road and runway building industries.

When there is a high fluid content within soil or other layers supporting pavement that carries vehicular traffic, reduced bearing capacity can occur, resulting in deformation of the contour of the road surface, wheel rutting, and premature collapse or failure of the roadway. The American Association for Safety and Highway Transportation Officials (AASHTO) issued design methodologies in 1993 that underscore the observation that damage to roadways occurs when fluid such as water is retained. In promulgating standards for quantifying the drainage performance of highways and other paved surfaces, AASHTO rates pavement drainage performances from "excellent," where water is removed from the roadway system within two hours, to "poor," where water is removed within one month. Drainage coefficients corresponding to these ratings are often used as direct design parameters in highway construction. For example, the drainage coefficient corresponding to an "excellent" drainage system in a roadway section would typically be at least two times greater than the corresponding drainage coefficient for "poor" drainage system in a similar section of roadway. In general, a drainage system having a higher drainage coefficient increases the corresponding effective structural rating of a section of roadway. Therefore, higher drainage coefficients generally correspond to a longer or extended service life, or result in the reduction of the overall structural cross-section, and therefore the amount of engineered materials, necessary to support a particular load.

Other engineering parameters reflect the importance of sufficient drainage to roadways. For example, the presence of water in pavement causes a reduction of the resilient modulus, which reduces the ability of a pavement surface to support traffic loads. In 1993, AASHTO reported that water saturation can reduce the dry modulus of asphalt paving by 30% or more. Moreover, added moisture in unbound aggregate base and sub-base layers was estimated to result in a loss of stiffness on the order of 50% or more. With water retention, a modulus reduction of up to 30% can be expected for an asphalt-treated base as well as an increased erosion susceptibility of cement or lime-treated bases. In addition, with inadequate drainage, saturated fine-grain road-bed soil may experience modulus reductions of over 50%. Furthermore, the presence of fluids often causes the buildup of hydraulic pore pressure that, in turn, reduces the effective stress capacity of the soil materials that were placed to support the pavement system.

Premature failure of pavement systems results in unacceptably high life-cycle costs for highways and other large paved structures. One conventional approach to the prevention of such premature failure from occurring has been directed toward developing means and methods for waterproofing roads. After years of expense and effort, however, waterproofing paved surfaces sufficiently to extend their useful life has proven to be quite challenging and somewhat unsuccessful. At the present time, industry focus has shifted from attempts at preventing water from entering the pavement surface to developing ways for removing water from the subbase and other base materials underlying the pavement. This shift in focus has been the subject of a number of publications in the field. One such publication is *Drainage of Highway and Airfield Pavements*, H. R. Cedegren (1987, R. E. K. Publishing Co.). In his book, Cedegren emphasizes that proper base and subbase drainage are considered to be more essential than paved surface waterproofing with respect to assuring that a pavement structure will perform for the duration of its design life. Cedegren projects that pavement useful life can be extended up to three times (e.g., a service life can be extended from 15 years, to 45 years) if adequate subsurface drainage systems are installed and maintained. The benefits of good drainage are also recognized in many current roadway design methodologies published in the early 1990's by AASHTO and the U.S. Army.

Other published studies support this view. In one of them, "*The Economic Impact of Pavement Subsurface Drainage*," R. A. Forsyth (1987, Transportation Research Record 1121, National Research Council, Washington, D.C.), the author reports at least a 33% increase in service life for asphalt pavement and a 50% increase for PCC pavements when subsurface drainage systems are used. Significantly, Forsyth observed a new crack reduction ratio of 2.4:1 when PCC pavements with subsurface drainage systems were compared to those without a subsurface drainage system. Moreover, other studies that reviewed pavements constructed to include base course layers constructed of non-uniform gradation, and consequently non-uniform and insufficient drainage capacity, concluded that service life was actually decreased by 50% when the pavement was saturated for periods as small as 10% of the year, that is, for approximately one month per year.

The economic disadvantages of inadequate subsurface drainage are significant. Indeed, KYDOT concluded that the costs of failing to properly drain a road could be up to $500,000 per mile when the costs of safety and repair delays are considered. KYDOT has also shown that providing a drainage mechanism along the edge of a road can improve road life by 40% when the system is installed properly. Other state agencies support this assessment. For example, the Maine DOT has observed that for an additional 20% increase in initial construction costs, proper drainage can double the expected useful life of a road. Studies by the University of Maine have quantified these observations with respect to actual soil permeability of various road bases throughout Maine. The University of Maine studies concluded that roads constructed with as little as 4% fines within the base and subbase courses drained at very slow rates, only two feet per day. This means that if a road, such as one observed in the study, had water traveling a typical distance of 20 feet, that is, 2 feet downwardly and 18 feet horizontally to a ditch or drain at the road's edge, it would take ten days for the road to drain, even if no additional fluids entered that same section of the road.

Thus, the rate at which water and other fluids are transported away from the various layers or levels of a paved surface is a critical element in its useful life. As can be easily seen, premature pavement failure due to inadequate drainage is an extremely serious and costly problem affecting the transportation infrastructure of North America and other areas. Indeed, Cedergren reported that 212 billion dollars U.S. was spent in 1991 on repairing highway deficiencies that were largely a result of poor drainage.

In one conventional method of approaching these drainage problems, an Open Graded Base Course, or "OGBC," drainable layer formed of natural stone and aggregate materials is installed beneath a roadway or other paved structure during its construction in an attempt to positively control fluids and dissipate pore pressures which commonly accumulate under large pavement structures. Typically, an OGBC-drainable pavement includes a layer of asphalt or concrete surface pavement, a permeable base, a separate filter layer, the sub-grade, and an edge drain. In theory, an OGBC drainable pavement provides a fluid-permeable zone beneath the pavement surface in order to alleviate the hydraulic problems attendant to poor drainage. On the other hand, the optimal performance of a pavement system is achieved by preventing water from entering the pavement and removing any water that does enter by means of a well-designed subsurface drainage system.

An OGBC is intended to be a porous drainage media that is capable of receiving fluids from the points of entry and then transporting them to designated discharge points in a timely manner. According to the FHWA, a typical OGBC permeable base is estimated to have a minimum permeability of 1,000 lineal feet per day. A permeability in this range will allow for drainage of the overlying pavement to occur within a few hours and thus would be considered as "excellent drainage" as defined by AASHTO. Because OGBC is installed as a highly porous and permeable system underneath an entire pavement section, it affords drainage to fluids regardless of their points of entry. For these reasons, OGBC has been viewed in the field as having acceptable parameters of fluid interception and drainage with respect to pavement systems.

OGBC is typically produced from stone that has been mined from quarries. A main distinguishing characteristic of OGBC materials is that they are usually delivered to work sites having a fairly uniform gradation per the specifications of the project engineer. Typically, project engineers use published standards for OGBC available from AASHTO, the Federal Highway Administration, or their resident state's department of transportation. Theoretically, uniform gradation of OGBC materials typically creates voids of desired and predictable dimension between them when they are in place. Thus, desired flow rates through both vertical and horizontal planes of the OGBC can be increased or decreased somewhat predictably by selecting appropriate size distributions of the particulate material.

Nonetheless, there are many disadvantages in OGBC drainage systems that appear to be caused by the lack of mechanical and dimensional stability provided by using uniform size gradations of stone. Although such gradations create interconnecting void spaces or holes with the aggregate for the purpose of receiving and transmitting fluid, OGBC by its very nature is susceptible to unacceptable amounts of lateral movement when exposed to shear stresses caused by typical traffic loading. This condition necessitates the need to chemically bond OGBC particulate materials to one another with cementitious or bituminous materials. The use of such bonding materials serves not only to increase costs, but to actually reduce the volume and extent of void space that remains within the OGBC. Thus, by addressing the problem of lateral stress, the void space required for sufficient drainage in an OGBC is reduced to unacceptable levels. Other disadvantages pertain to the additional elements that are required in an OGBC installation. Typically, a well graded granular or geotextile filter layer is needed above the OGBC in order to prevent contamination of the OGBC from the migration of sub-grade fines. This extra filter layer further increases the costs of the roadway construction.

Although an OGBC's interconnected void spaces may afford an acceptable level of drainage for some applications, the use of an OGBC conflicts with many established road pavement design practices. This is the case because roadways designed for long-term use often require the elimination of void spaces in order to obtain strength, reduce the movement of particles, sand and aggregate, and thereby increase the load-carrying capacity of the paved surface. Furthermore, unacceptably high construction costs are sometimes incurred when using an OGBC because of the need for precision and extensive on-site quality control in order to increase the chances that a high-flow OGBC system will last for the life of the overlying paved surface.

Another particular problem with the use OGBC's for drainage relates to their long-term performance. It is not uncommon to find distress in some OGBC systems after only a few years of apparently satisfactory service. Initial indications are that the drainage from the system has slowed and that the pavement and one or more base layers are moving with respect to one another, resulting in loss of sufficient support to overlying pavement layers. Some researchers and practitioners have suggested that the failure of an open-graded base course as a drainage layer is far more detrimental to the stability of a paved surface then the presence of a fluid-saturated dense-graded base course. For this and related reasons, current concerns now focus on the long-term stability and hydraulic conductivity of the open-graded bases and their effect on pavement performance.

The hydraulic conductivity of OGBC's over time is susceptible to the deleterious clogging effects of the upward migration of subgrade soil particles into the layer, as well as from the infiltration of fine particles from fractures in the pavement surface. While there is still a need to determine the optimum balance between stability and hydraulic conductivity for the least cost, equally important is the need to identify construction methods and materials for maintaining the initial stability and hydraulic characteristics of an OGBC over time.

Yet another problem with the OGBC is that quality aggregate is not always available or, if available, at uneconomically or prohibitively high costs. There is therefore a need for a drainage system that utilizes components which can be engineered and manufactured offsite, which provide equivalent or superior flow to OGBC's and that can be integrated economically within a large paved structure to provide efficient and cost-effective drainage for the structure, while also providing sufficient dimensional, mechanical and hydraulic capability.

In general, geosynthetics are manufactured from polymeric materials, typically by extrusion, as substantially planar, sheet-like, or cuspidated products. Geosynthetics are usually made in large scale, e.g., several meters in width and many meters in length, so that they are easily adaptable to large-scale construction and landscaping uses. Many geosynthetics are formed to initially have a substantially planar configuration. Some geosynthetics, even though they are initially planar, are flexible or fabric-like and therefore conform easily to uneven or rolling surfaces. Some geosynthetics are manufactured to be less flexible, but to possess great tensile strength and resistance to stretching or great resistance to compression. Certain types of geosynthetic materials are used to reinforce large man-made structures, particularly those made of earthen materials such as gravel, sand and soil. In such uses, one purpose of using the geosynthetic is that of holding the earthen components together by providing a latticework or meshwork whose elements have a high resistance to stretching. By positioning a particular geosynthetic integral to gravel, sand and soil, that is with the gravel, sand and soil resident within the interstices of the geosynthetic, unwanted movement of the earthen components is minimized or eliminated.

Most geosynthetic materials, whether of the latticework type or of the fabric type, allow water to pass through them to some extent and thus into or through the material within which the geosynthetic is integrally positioned. Thus, geosynthetic materials and related geotechnical engineering materials are used as integral part of manmade structures or systems in order to stabilize their salient dimensions.

Until recently, the only geosynthetic materials available for pavement drainage were exclusively limited to drains at the edge or shoulder of a roadway. These edge-drain systems are commonly located within a covered trench dug along the shoulder of the roadway during its construction. Conventional edge drain geosynthetics, however, cannot withstand the repeated dynamic loads that are present directly beneath pavement surfaces.

The present invention thus offers a range of synthetic void-maintaining laminate products which overcome the many deficiencies of the OGBC. The present invention relates generally to synthetic void-maintaining structures with high permittivity and high transmissivity that are capable of extending the life of pavement and other large structures by removing undesirable fluids. The present invention includes a myriad of high-flow void-maintaining membrane laminates ("VMML's") which possess desirable properties that make them capable of being a suitable partial, or full, replacement for conventional road-building materials such as OGBC's.

The preferred embodiments of the present invention of high throughput void-maintaining laminates overcome the previously mentioned disadvantages by providing a plurality of interconnected voids of great mechanical and dimensional stability while simultaneously providing sufficient horizontal flow to perform in accordance with "Good to Excellent" drainage when assessed with AASHTO definitions. These performance attributes are one desirable aspect of the present VMML systems because they eliminate many of the problems associated with fluids underlying large structures that are not resolved by conventional OGBC systems or by other geosynthetic products. By reducing or eliminating these problems, VMML systems extend the useful life of the overlying structure.

In accordance with other aspects of the present invention, VMML's can be positioned in a roadway to maximize their effectiveness, for example, directly beneath the pavement surface, immediately beneath the base course, or directly above a sub-grade if a sub-base is not present.

VMML's according to the invention can be made in large pieces, for example, several meters wide and many meters long. Moreover, for convenience in installation, VMML's may be installed in portions which are interconnected such that the interconnecting voids are of sufficient dimension that the water from a large structure such as a roadway can move freely through the VMML and can be connected to drain means such as a perforated pipe, ditch, or culvert adjacent to the pavement structure.

VMML's of the present invention can be fabricated into panels of various lengths and widths by using a means to weld, tie or sew VMML sections to one another to form one or more continuous VMML pathways underneath construction soils and pavement. Typically, a VMML of the present invention is positioned so that it is installed beneath pavement and above the natural soil native to the construction site. Also typically, the present VMML's reduce the distance to drain from the horizontal plane governed by the slope to the vertical distance between the SDBC and the fluid entry point.

SUMMARY OF THE INVENTION

It is therefore an object of the present invention to provide geocomposite laminates which possess a high resistance to compression when under load, while maintaining desired flow characteristics through their upper layers and cores.

It is also an object of the invention to provide means and methods for combining two or three layers of thermoplastic into such geocomposite laminates.

It is a similar object of the invention to provide void-maintaining laminates that are constructed and arranged to meet specified performance characteristics.

In accordance with these and other objects, the present invention provides geocomposites in the form of void-maintaining laminates, each laminate comprising a sheet-like base layer, the base layer having a lower surface and an upper surface, a plurality of compression elements extending from the upper surface of the base layer, each of the compression elements comprising a base, a tip located distal to the base, a shaft extending between the base and the tip, a shaft axis having a length measured from the base to the tip, and a neck diameter measured substantially perpendicular to the shaft length at a narrowest portion of the shaft; and a top layer, the top layer having a permittivity to fluids, and wherein the top layer is attached to a plurality of the compression elements at their respective tips.

In some embodiments, the compression elements are contiguous with the top surface of the base layer although compression elements may be adapted and arranged in any way which permits them to cooperate with a base layer and top layer to produce the desired void-maintaining capabilities. The compression elements of the invention are provided in any shape, or combination of shapes, which can be constructed, combined or arranged to produce the desired void-maintaining capabilities in cooperation with a base layer and fluid-permeable top layer. Such shapes include but are not limited to, for example, one or more of spikes, hollow spikes, cones, hollow cones, spindles, convolutions, bubbles, circular cylinders, ovoid cylinders, hollow cylinders, flat-faceted pyramids, arcuate-faceted pyramids, volcano-shaped columns, mushroom-shaped columns, tubes, sphere-topped shafts, and peduncles.

The tips of compression elements according to the invention are adapted and shaped such that attachment of the tips to the upper layer can be accomplished. To this end, in some embodiments of the invention, the compression element tips are provided with one or more flattened facets adapted and arranged to provide attachment surfaces for the upper layer. In one aspect of the invention, the compression elements define voids between the top surface of the base layer, the top layer and the compression elements themselves. In some embodiments of laminates according to the invention, the base layer is impermeable to fluids. Thus, the fluid-impermeable bottom layer, along with the surfaces of the compression elements in the core of the laminate and the top layer, maintains void spaces to the extent that channels or paths for the egress of fluid from the laminate are provided.

In certain embodiments of laminates of the invention, where compression elements are contiguous with the bottom layer, voids or hollows, are provided in the bottom surface of the base layer to advantageously save on the amount of material necessary to create a certain amount of laminate. In such embodiments, the voids are adapted and arranged to correspond in position to the compression elements extending from the upper surface of the base layer, thereby forming a hollow compression element.

In accordance with other objects of the invention, the top layer of some embodiments of the invention comprises one or more of membranes, grids and geotextiles, depending upon the performance specifications of the desired product. The degree of attachment of the upper layer to the core layer of compression elements of a laminate of the invention is another parameter which can be varied according to the types of materials being used, the manner in which the layers are attached to one another, and the desired performance characteristics of a particular installation. Thus, in some embodiments, the top layer is attached preferably to at least 25% of the tips of the plurality of compression elements which form the core layer of the laminate. In other embodiments, the top layer is attached to at least 50% of the tips of the plurality of compression elements. In still other embodiments of laminates according to the invention, the top layer is attached to at least 80% of the tips of the plurality of compression elements of the core. In still further embodiments, the top layer is attached to at least 90%, or to at least 95% of the tips of the plurality of compression elements.

Preferably, the top layer of a laminate according to the invention is attached to the tips of the corresponding plurality of compression elements with a bond strength of at least 0.05 lbs/square inch of attachment surface, or at least 0.10 lbs/square inch of attachment surface, or at least 0.15 lbs/square inch of attachment surface. Another advantageous aspect of the present invention pertains to the ratio of the shaft length to the neck diameter of compression elements. The neck diameter of a compression element is its narrowest diameter. Thus, in some embodiments with substantially cylindrical compression elements, the neck diameter is the same, or nearly the same, at several levels along the length of the shaft of the compression element, and at the tip. Preferably, the ratio of the shaft length to the neck diameter of the plurality of compression elements is at least 1.0-1.0, or at least 2.0-1.0, or at least 3.0-1.0. In other embodiments the ratio of the shaft length to the neck diameter of the plurality of compression elements is at least 4.0-1.0, or at least 5.0-1.0. Thus, one way in which the overall dimensions of compression elements of a selected shape of the core layer of a laminate according to the invention can be determined is in relation to their respective neck diameters.

Thus, in some embodiments, laminates of the invention are preferably formed from compression elements having a neck diameter of at least 0.5 mm, at least 2.0 mm, at least 4.0 mm, or at least 6.0 mm. In other preferred embodiments, laminates of the invention are formed from compression elements having a neck diameter of at least 10.0 mm, of at least 15.0 mm, of at least 20.0 mm, or of at least 25.0 mm. In another key aspect, the plurality of compression elements which are provided on the base layer in one or more selected shapes are disposed in a density sufficient to meet the desired performance specifications for an intended installation. Preferable density ranges of compression elements thus include a density of at least 1.0 per square inch, of at least 2.0 per square inch, of at least 3.0 per square inch, of at least 4.0 per square inch, of at least 10.0 per square inch, and of at least 20 per square inch.

In another aspect, laminates of the invention can be constructed and arranged with respect to the relative proportion of the cross-sectional areas of the compression elements of the core to the area of the bottom layer to which they are attached. In this aspect, the percent ratio of the total cross-sectional area of the neck diameters is preferably at least 5% of the area of the bottom layer to which they are attached, at least 10%, at least 15%, or at least 20% of the area of the bottom layer to which they are attached. In other embodiments, the percent ratio of the total cross-sectional area of the neck diameters is preferably at least 25%, at least 35%, or at least 50% of the area of the bottom layer to which they are attached.

Laminates of the present invention can also be constructed and arranged such that a desired dimensional relationship between the average width of the voids defined between the compression elements, the base layer and the top layer is achieved. For example, laminates of the invention comprehend those wherein the average width of the voids defined between the compression elements, the base layer and the top layer is less than the width of the base of the compression elements as well as those where the average width of the voids defined between the compression elements, the base layer and the top layer is more than the average width of the base of the compression elements. The present invention also comprehends those which are constructed and arranged such that the average height of the compression elements is less than the average width of the base of the compression elements, or more than the average width of the base of the compression elements.

In some preferred embodiments, the compression elements of the core of laminates of the invention are evenly spaced on the base layer in a grid-like pattern. In other embodiments, compression elements are distributed in non-grid-like patterns or in random arrangements so long as the laminate meets desired performance characteristics.

Laminates of the invention can be made from any material which permits the selection and combination of the three layers in a way that desired performance characteristics are achieved. Preferably, laminates of the invention are formed of one or more thermoplastics such as polyethylene, high density polyethylene ("HDPE"), polypropylene, glass-filled plastics, and ABS.

Thus, by choosing one or more shapes, sizes and densities of compression elements as disclosed herein, and by combining them with a base layer and a top layer also as described herein, laminates having desired transmissivities can be provided. For example, the present laminates comprehend those having a transmissivity of at least $10^{-3}$ $M^2$ $sec^{-1}$ of aqueous liquid at a normal load of at least 100 PSF (pounds/$ft^2$), sustainable for at least 100 hours when tested in accordance w/ ASTM 4716 as well as those having a transmissivity of at least $10^{-3}$ $M^2$ $sec^{-1}$ of aqueous liquid at a normal load of at least 1,000 PSF (pounds/$ft^2$) sustainable for at least 100 hours when tested in accordance w/ ASTM 4716, and those possessing a transmissivity of at least $10^{-3}$ $M^2$ $sec^{-1}$ of aqueous liquid at a normal load of at least 10,000 PSF (pounds/$ft^2$) sustainable for at least 100 hours when tested in accordance w/ ASTM 4716.

Moreover, by choosing other combinations of shapes, sizes and densities of compression elements as disclosed herein, and by combining them with a base layer and a top layer also as described herein, the present invention also comprehends laminates having transmissivities of at least $10^{-3}$ $M^2$ $sec^{-1}$ of aqueous liquid at a normal load of at least 15,000 PSF (pounds/$ft^2$) sustainable for at least 100 hours when tested in accordance w/ ASTM 4716, and those with a transmissivity of at least $10^{-3}$ $M^2$ $sec^{-1}$ of aqueous liquid at a normal load of at least 20,000 PSF (pounds/$ft^2$) sustainable for at least 100 hours when tested in accordance w/ ASTM 4716.

In accordance with yet additional objects of the invention, a method for designing void-maintaining laminates to meet desired specifications is provided. The method comprises the acts or steps of providing a base layer, wherein the base layer comprises a plurality of compression elements, the compression elements being contiguous with the base layer, and the compression elements comprising compression element tips which are i) located distal to the base layer, and ii) disposed substantially perpendicular to the base layer; providing a fluid-permeable geotextile top layer, wherein the top layer is attached to a plurality of the compression element tips such that the desired specifications are achieved. Preferably, the compression elements are provided in shapes, and the shapes are selected from one or more of spikes, hollow spikes, cones, hollow cones, spindles, convolutions, bubbles, circular cylinders, ovoid cylinders, hollow cylinders, flat-faceted pyramids, arcuate-faceted pyramids, volcano-shaped columns, mushroom-shaped columns, tubes, sphere-topped shafts, and peduncles. The tips of the compression elements are preferably provided with one or more flattened facets adapted and arranged to provide attachment surfaces for the upper layer, and the compression elements define voids between the top surface of the base layer and the top layer.

Further description of the invention is provided by the explication of the drawings herein, which show examples of the invention. Although the descriptions provided herein are accurate, they are but a few examples of the many embodiments which are comprehended by the present specification and claims. Accordingly, the invention is not limited by the exemplary embodiments described herein but encompasses many permutations of laminates.

BRIEF DESCRIPTION OF THE DRAWINGS

FIG. 1(*b*) shows the embodiment of FIG. 1(*a*) combined with an upper fluid-permeable layer according to the invention;

FIG. 1(*c*) is a top oblique view of the embodiment of FIG. 1(*a*);

FIG. 1(*d*) is a top oblique view of the embodiment of FIG. 1(*a*) wherein the base layer comprises a grid having apertures disposed between the compression elements;

FIG. 2(*b*) shows the embodiment of FIG. 2(*a*) combined with an upper fluid-permeable layer according to the invention;

FIG. 3(*b*) shows the embodiment of FIG. 3(*a*) combined with an upper fluid-permeable layer according to the invention;

FIG. 7(*b*) shows the embodiment of FIG. 7(*a*) combined with an upper fluid-permeable layer according to the invention;

FIG. 9(*b*) shows the embodiment of FIG. 9(*a*) combined with an upper fluid-permeable layer according to the invention.

DETAILED DESCRIPTION OF THE INVENTION

Figure 1A:
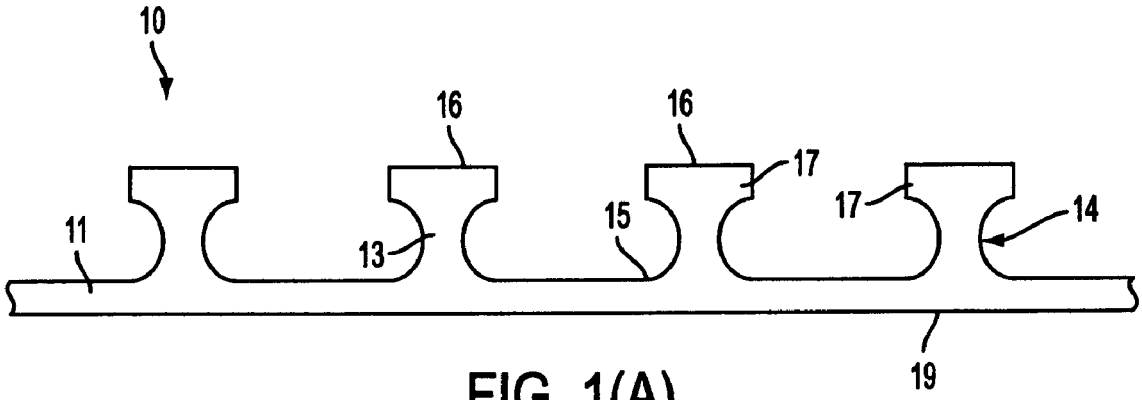
FIG. 1(*a*) is a cross-sectional view of an embodiment of the invention having flat-topped spindle-shaped compression elements being contiguous with a base layer of like material.

FIG. 1(*a*) is a cross-sectional view of an embodiment of the invention having flat-topped spindle-shaped compression elements 13 being contiguous with a base layer 11 of like material. With respect to FIG. 1(A), void-maintaining unitary layer 10 has base sheet-like layer 11 with contiguous compression elements 13 protruding from base sheet 11 at compression element junction 15 and opposite base layer bottom surface 19. Each of compression elements 13 has a neck 14 and each element 13 is provided with a flattened attachment surface 16 at each of tips 17 useful for attaching a fluid-permeable layer, grid or scrim to compression element tips 17 of unitary layer 10.

Figure 1B:
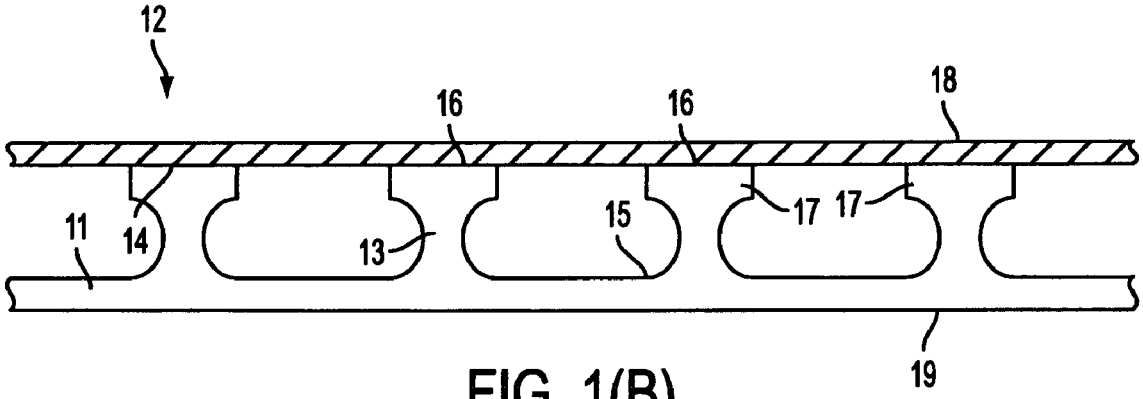

FIG. 1(B) shows void-maintaining unitary layer 10 of FIG. 1(A) combined with upper fluid-permeable layer needle-punched geomembrane 18 which is attached, for example, by heat fusion to unitary layer 10 at a plurality of attachment surfaces 16 of tips 17.

Figure 1C:
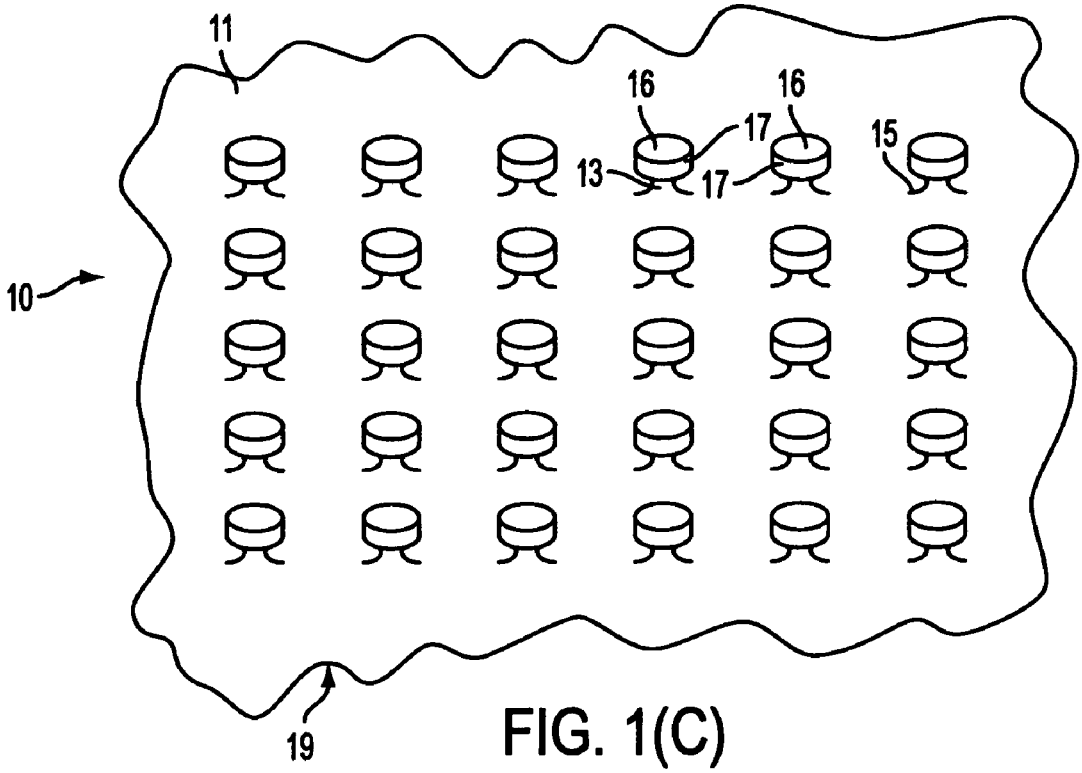

FIG. 1(C) is a top oblique view of the embodiment shown in FIG. 1(A) and shows the flattened surfaces 16 of tips 17 of compression elements 13 which arise from the surface of base sheet 11 opposite bottom surface 19.

Figure 1D:
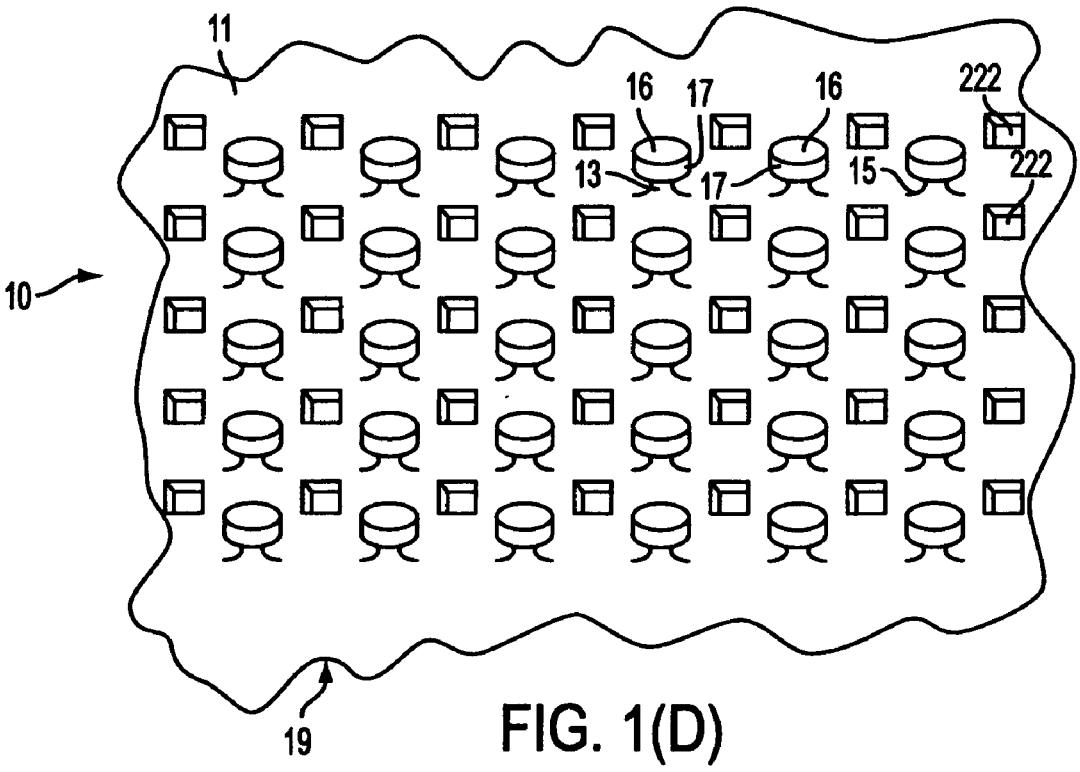

FIG. 1(D) is a top oblique view of the embodiment of FIG. 1(A) wherein the base layer is further provided with a grid having apertures 222 disposed in a grid-like pattern between and among compression elements 13.

Figure 2A:
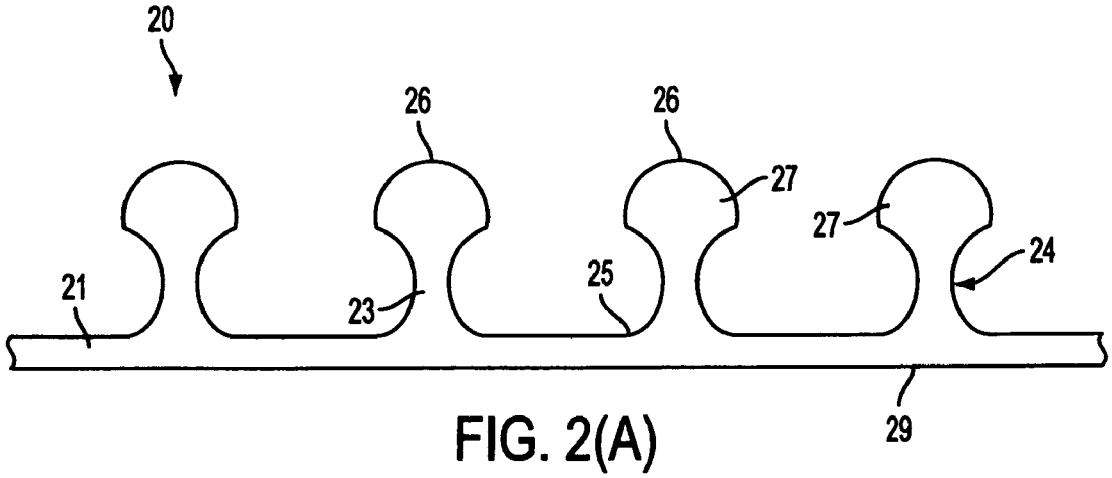
FIG. 2(*a*) is a cross-sectional view of an embodiment of the invention having bulb-shaped compression elements being contiguous with a base layer of like material.

FIG. 2(A) is a cross-sectional view of an embodiment of the invention having bulb-shaped compression elements 23 being contiguous with a base layer 21 of like material. With respect to FIG. 2(A), void-maintaining unitary layer 20 has base sheet 21 with contiguous compression elements 23 protruding from base sheet 21 at compression element junctions 25 and opposite bottom surface 29. Compression elements 23 are provided with necks 28, and with arcuate attachment surfaces 26 useful for attaching a fluid-permeable layer to unitary layer 20.

Figure 2B:
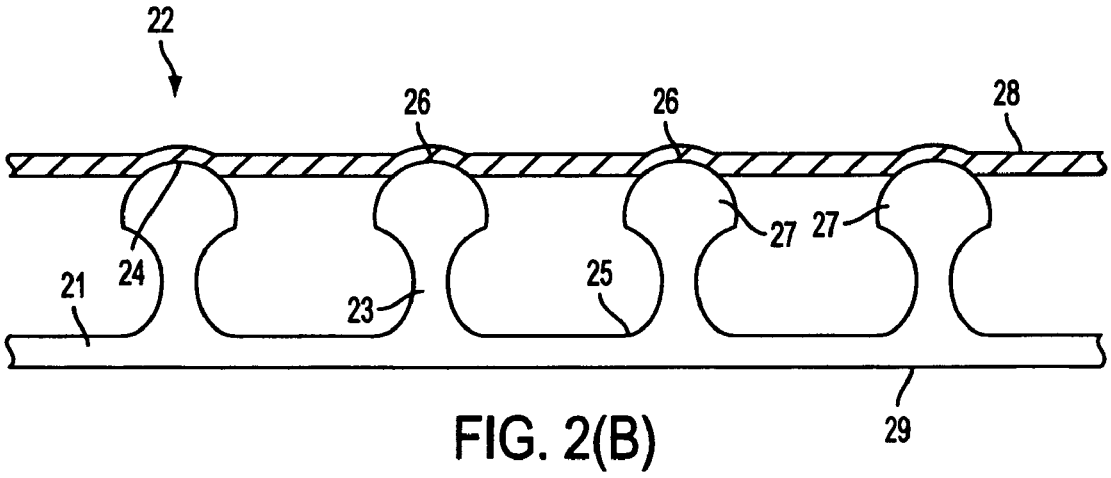

FIG. 2(B) shows the void-maintaining unitary layer 20 of FIG. 2(A) combined with upper fluid-permeable layer needle-punched geomembrane 28 which is attached, for example, by heat fusion, to unitary layer 20 at a plurality of attachment surfaces 26.

Figure 3A:
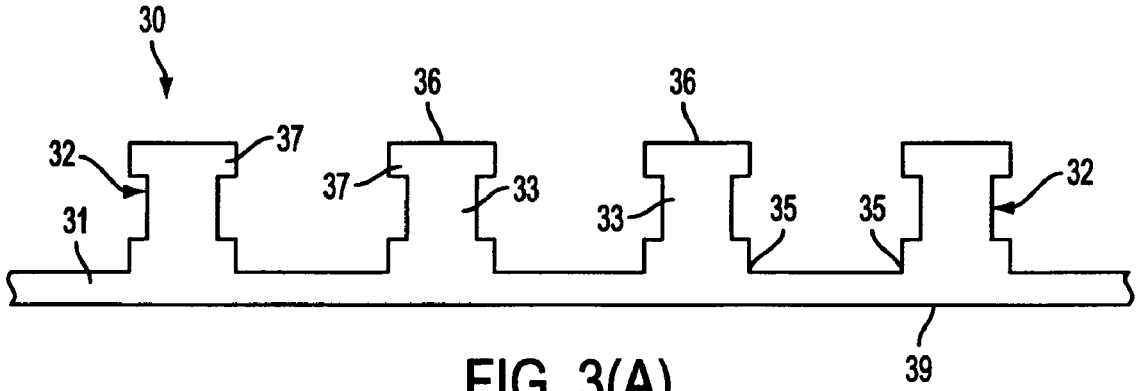
FIG. 3(*a*) is a cross-sectional view of an embodiment of the invention having spool-shaped compression elements being contiguous with a base layer of like material.

FIG. 3(A) is a cross-sectional view of an embodiment of the invention having spool-shaped compression elements 33 being contiguous with base layer 31 of like material. With respect to FIG. 3(A), void-maintaining unitary layer 30 has base sheet 31 with contiguous compression elements 33 protruding from base sheet 31 at compression element junctions 35 and opposite bottom surface 39. Each of compression elements 33 is provided with a neck 32 and with flattened attachment surfaces 36 useful for attaching a fluid-permeable layer to unitary layer 30.

Figure 3B:
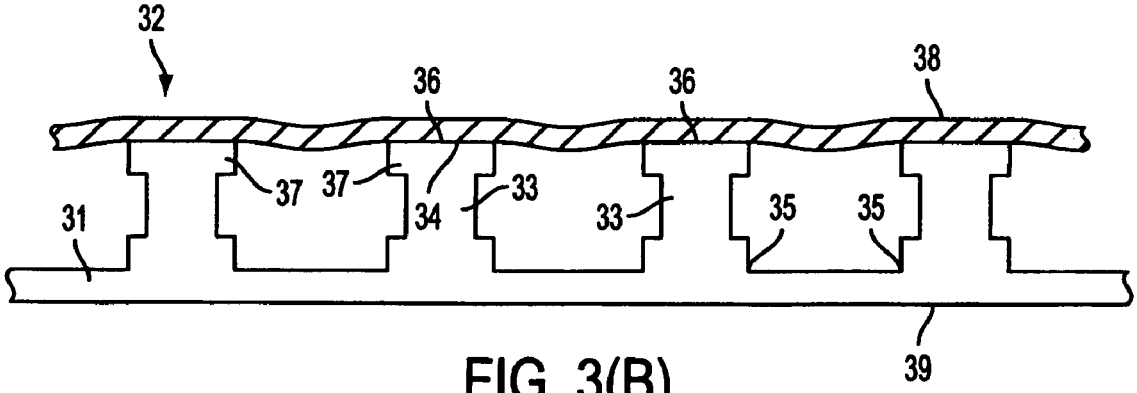

FIG. 3(B) shows the void-maintaining unitary layer 30 of FIG. 3(A) combined with upper fluid-permeable layer needle-punched geomembrane 38 which is attached, for example, by heat fusion to unitary layer 30 at a plurality of attachment surfaces 36.

Figure 4:
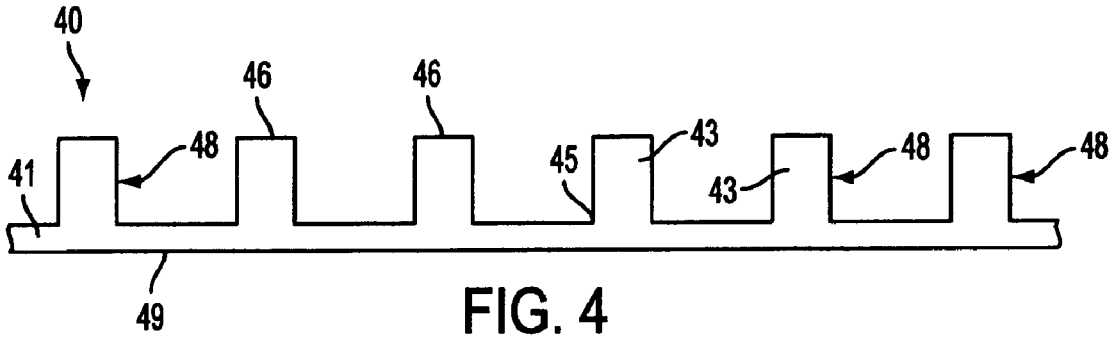
FIG. 4 is a cross-sectional view of an embodiment of the invention having flat-topped cylinder-shaped compression elements being contiguous with a base layer of like material.

FIG. 4 is a cross-sectional view of an embodiment of the invention having cylinder-shaped compression elements 43, each of which has a neck 48, and each element 43 being contiguous with base layer 41, preferably formed of like material. With respect to FIG. 4, void-maintaining unitary layer 40 has base sheet 41 with contiguous compression elements 43 protruding from base sheet 41 at compression element junctions 45 and opposite bottom surface 49. Compression elements 43 are provided with flattened attachment surfaces 46 useful for attaching a fluid-permeable layer to unitary layer 40.

Figure 5:
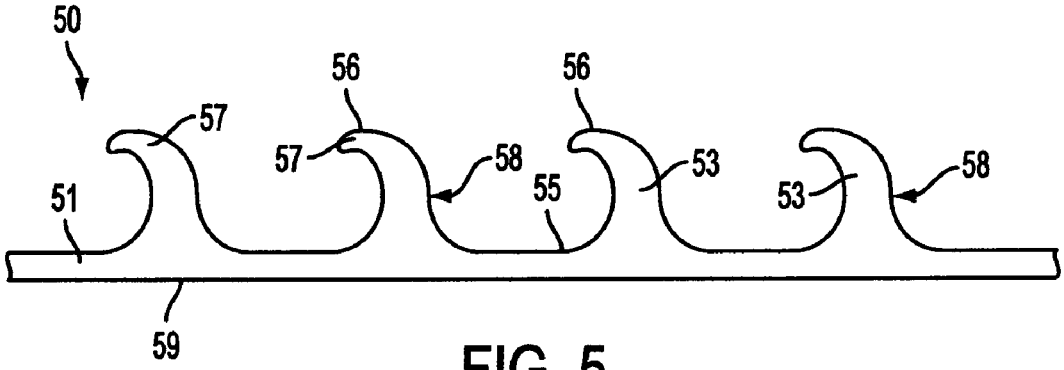
FIG. 5 is a cross-sectional view of an embodiment of the invention having peduncle-shaped compression elements being contiguous with a base layer of like material.

FIG. 5 is a cross-sectional view of an embodiment of the invention having peduncle-shaped compression elements 53 being contiguous with base layer 51 of like material. With respect to FIG. 5, void-maintaining unitary layer 50 has base sheet 51 with contiguous compression elements 53 protruding from base sheet 51 at compression element junctions 55 and opposite bottom surface 59. Compression elements 53 are provided with attachment surfaces 56 useful for attaching a fluid-permeable layer to unitary layer 50, and with necks 58.

Figure 6:
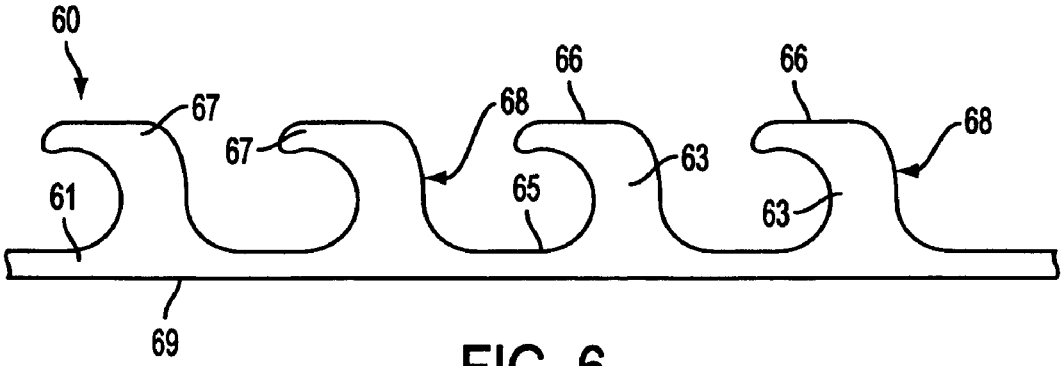
FIG. 6 is a cross-sectional view of an embodiment of the invention having flat-topped peduncle-shaped compression elements being contiguous with a base layer of like material.

FIG. 6 is a cross-sectional view of an embodiment of the invention having peduncle-shaped compression elements 63 being contiguous with base layer 61 of like material. With respect to FIG. 6, void-maintaining unitary layer 60 has base sheet 61 with contiguous compression elements 63 protruding from base sheet 61 at compression element junctions 65 and opposite bottom surface 69. Compression elements 63 are provided with necks 68 and flattened attachment surfaces 66 useful for attaching a fluid-permeable layer to unitary layer 60.

Figure 7A:
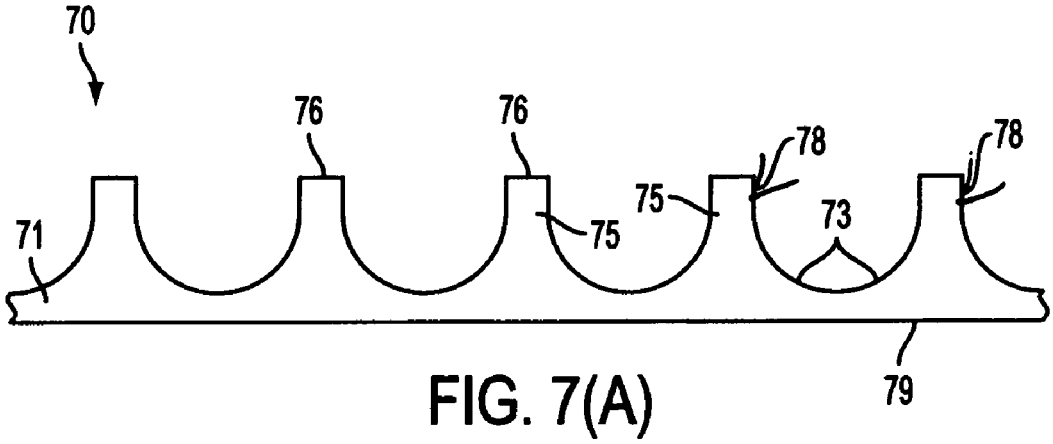
FIG. 7(*a*) is a cross-sectional view of an embodiment of the invention having flat-topped mesa-shaped compression elements being contiguous with a base layer of like material.

FIG. 7(A) is a cross-sectional view of an embodiment of the invention having mesa-shaped compression elements 73 being contiguous with base layer 71 of like material. With respect to FIG. 7, void-maintaining unitary layer 70 has base sheet 71 with contiguous compression elements 73 protruding from base sheet 71 at compression element junctions 75 and opposite bottom surface 79. Compression elements 73 are provided with necks 78 and flattened attachment surfaces 76 useful for attaching a fluid-permeable layer to unitary layer 70.

Figure 7B:
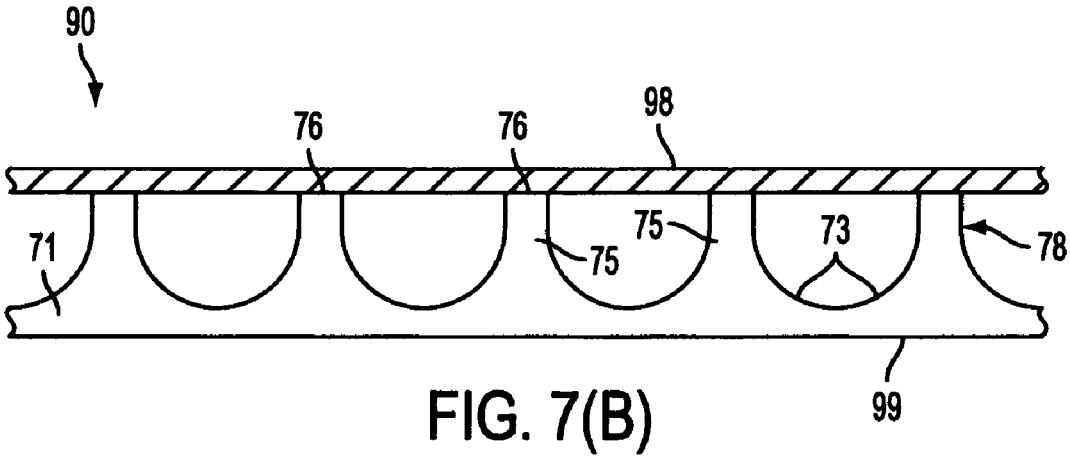

FIG. 7(B) shows void-maintaining unitary layer 70 of FIG. 7(A) combined with upper fluid-permeable layer needle-punched geomembrane 78 which is attached, for example, by heat fusion to unitary layer 70 at a plurality of attachment surfaces 76 of compression elements 75.

Figure 8:
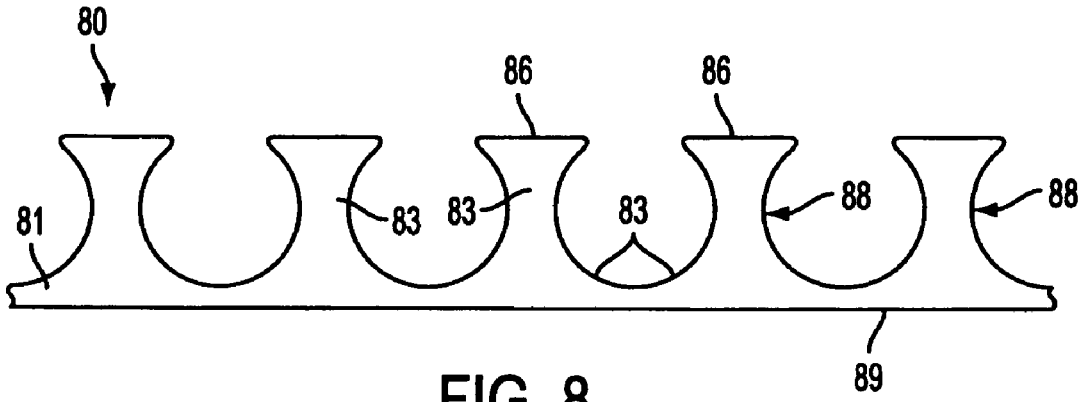
FIG. 8 is a cross-sectional view of an embodiment of the invention having splay-topped mesa-shaped compression elements being contiguous with a base layer of like material.

FIG. 8 is a cross-sectional view of an embodiment of the invention 80 having splay-topped mesa-shaped compression elements 83 being contiguous with base layer 81 of like material. With respect to FIG. 8, void-maintaining unitary layer 80 has base sheet 81 with contiguous compression elements 83 protruding from base sheet 81 at compression element junctions 85 and opposite bottom surface 89. Compression elements 83 are provided with necks 88 and flattened attachment surfaces 86 useful for attaching a fluid-permeable layer to unitary layer 80.

Figure 9A:
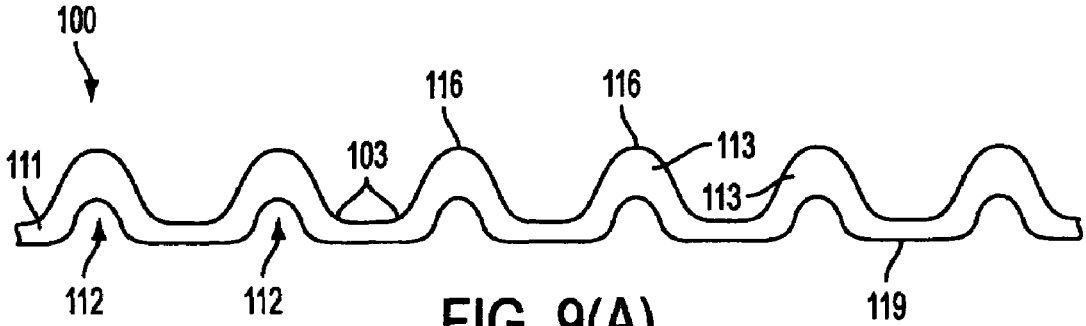
FIG. 9(*a*) is a cross-sectional view of an embodiment of the invention having hollow cone-shaped compression elements being contiguous with a base layer of like material.

FIG. 9(A) is a cross-sectional view of an embodiment 100 of the invention having hollow cone-shaped compression elements 113 being formed within, and contiguous with, base layer 111, which is preferably of like material. With respect to FIG. 9(A), void-maintaining unitary layer 100 has base sheet 111 with contiguous compression elements 113 protruding from base sheet 111 at compression element junctions 103 and opposite bottom surface 119. Base sheet 111 has base hollows 112 formed therein, each of which corresponds in position to a compression element 113. Thus, embodiment 100 can be formed, for example by dimpling a base sheet of appropriate dimension to form both hollows 112 and compression elements 113. Compression elements 113 are provided with curved attachment surfaces, or tips, 116, useful for attaching fluid-permeable layer to unitary layer 100.

Figure 9B:
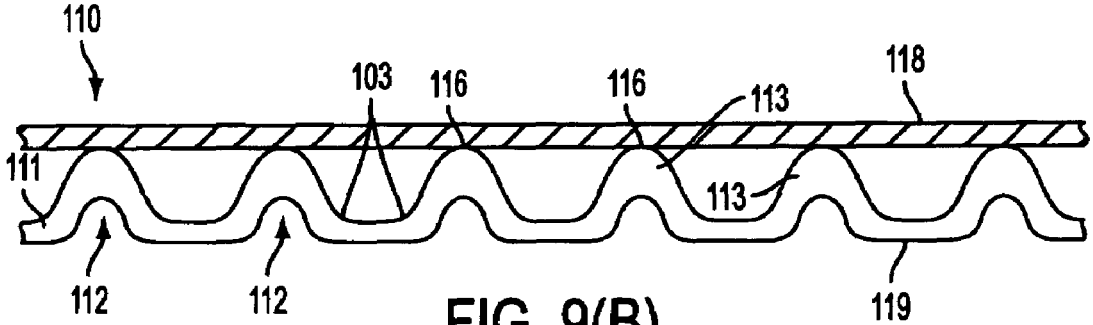

FIG. 9(B) shows the void-maintaining unitary layer 100 of FIG. 9(A) combined with upper fluid-permeable needle-punched geomembrane layer 118 which is attached, for example, by heat fusion to unitary layer 100 at a plurality of attachment surfaces 116.

The present invention therefore provides a myriad of embodiments wherein a plurality of compression elements of various shapes, such as spikes, cones, cylinders, pyramids or volcano-shaped columns, mushrooms, or tubes are disposed between a top layer which is permeable to fluids such as water and gases, and a bottom layer that is typically impermeable to fluids, such that the voids between the two layers and among the CE's are maintained to the extent necessary to achieve defined performance characteristics.

In some preferred embodiments, the present invention comprises a top layer which is a fluid-permeable geotextile. CE's according to the invention can be solid or hollow depending upon the performance characteristics required of them, and the polymers of which they are made. Critical to the void-maintaining characteristics of the invention is the plurality of connections that exist between the tips of the CE's and the upper layer of impermeable membrane, grid or geotextile that is adjacent thereto.

Essentially, the horizontal connections between the upper layer of geotextile, scrim or geonet, and the tips of any two CE's, act much the same as a suspension bridge. Downward force, typically pressure from the overburden on the upper layer, is also transmitted horizontally through the upper layer as horizontal tension between any two CE's. This tension is communicated to the CE's by the connections between any CE-TE pair. Thus, in some embodiments, a significant characteristic of the upper layer, or of a scrim or grid within the upper layer, is its tensile strength, that is, its resistance to elongation and ability to act as a tension element ("TE") between any two or more CE's. This resistance to elongation of the TE's helps maintain the relative position of any pair or group of CE's connected by portions of the upper layer. Similarly, the tensile characteristics of the plurality of connections between a corresponding plurality of CE's thereby increases the ability of the CE's to maintain their relative position to one another and to the layers of the laminate as a whole to thereby maintain voids while under pressure. In other embodiments, because of the dimensions of the CE's and the strength of their attachment to the upper layer, the tensile strength of the upper layer is of lesser significance. In all embodiments, however, an important characteristic of the laminates is the plurality of connections that exist between the CE's of the void-maintaining core and the TE's formed in combination with an upper layer or layers.

In another aspect, the present invention provides laminates where the CE's are provided in densities appropriate to achieve the desired performance characteristics. Thus, by providing CE's having certain individual strengths at a desired number per unit area, the desired voids and corresponding flow characteristics are maintained. Moreover, the types and dimensions of the CE's are adaptable to particular applications. Thus, the invention includes a myriad of permutations where various selections of compression elements as components of the void-maintaining core, and tension elements as components of the upper membrane, are combined according to their respective engineering parameters to yield a geocomposite of desired void-maintaining characteristics.

In yet another aspect, the present invention provides patterns of drainage channels disposed within a laminate. In such patterned embodiments, selected CE's, in the shape of the desired channel patterns through the laminate, are adhered to the upper layer while other portions of the CE's are not adhered. Thus, some portions of the laminate are void-maintaining while others are not. This permits the provision of directed high-flow drainage in selected portions of a product according to the invention, and selected other portions of less transmissivity, features not found in conventional geocomposites.

Compression elements according to the invention can be provided in any shape that possesses sufficient strength with respect to compressability and tensile strength that, in combination with a plurality of other CE's, a substantial plurality of which are attached to the upper membrane layer, yields the performance characteristics desired in the laminate.

One particularly useful embodiment of the invention is a void-maintaining geocomposite laminate comprising a core element including a plurality of cone-shaped compression elements, each of the compression elements having a longitudinal axis, a base, and a tip, and a longitudinal height measured along the longitudinal axis, the core element having a core element upper surface, and a core element lower surface. Attached to the core element lower surface is an impermeable base layer, preferably of polymer materials, such as polyethylene, high density polyethylene (HDPE), polypropylene, glass-filled plastics, and ABS, as are sometimes used in other products in the geotechnical field. The CE's in such an embodiment can be solid, hollow, or partially hollow. A geotextile of desired permittivity and transmissivity characteristics is attached to a plurality of tips of the core element, that is, to the upper surface or plane of the compression elements which make up the void-maintaining core element. Thus, many or all of the tips of the CE's of the core are fused or adhered in some manner to the upper layer. This adhesion or fusion of the CE's to the upper geotextile layer can be accomplished by any means which yields a sufficient bond between the respective elements so that the desired performance characteristics are achieved, such as by laser welding, radio frequency welding, ultrasonic welding, or by heat. Thermal attachment of the upper layer to a substantial plurality of the tips of the cone-shaped CE's may be achieved, for example, by heat welding, laser fusion or flame welding to the extent necessary that the laminate has a desired transmissivity.

In some preferred embodiments, the longitudinal axes of the CE's according to the invention are preferably aligned parallel to one another and substantially normal to the plane of the base layer. In other embodiments, the longitudinal axes of the CE's according to the invention are aligned parallel to one another but at an angle of from 89 to 45 degrees from the plane of the base layer. In still other embodiments, the longitudinal axes of a plurality of the CE's are aligned randomly (non-parallel) to one another but at angles in the range of from 90 to 45 degrees from the plane of the base layer.

In still another aspect, the upper layer of a laminate according to the invention comprises a high-tensile membrane layer, a grid, a scrim or net. In other embodiments, the bases of the CE's are contiguous with one another. In additional embodiments, the bases of the CE's are contiguous with the base layer, or are attached thereto at the lower surface of the core element. Membrane upper layers according to the invention preferably comprise a fluid-transmissible geotextile but may include any layer which is attachable to the core element at a plurality of points for purposes of, for example, increasing the tensile strength of the upper layer or layers.

The present invention also includes embodiments where selected CE's, in the shape of channels through the laminate, are adhered to the upper layer while other portions of the CE's are not. Thus, some portions of the laminate are void-maintaining while others are not. This permits the provision of directed drainage, a feature not found in conventional geotechnical products. An additional advantage is found in the characteristic that the aspect ratio, that is, the ratio between the neck width of the CE, that is, the cross-sectional area of the CE measured at its narrowest diameter, to its overall height, can be selected to provide CE's of desired individual strengths and performance characteristics.

What is claimed is:

1. A void-maintaining laminate comprising a) a sheet-like base layer, said base layer having a lower surface and an upper surface;

b) a plurality of compression elements extending from said upper surface of said base layer, each of said compression elements comprising a base, a tip located distal to said base, a shaft extending between said base and said tip, a shaft axis having a length measured from said base to said tip, and a neck diameter measured substantially perpendicular to said shaft length at a narrowest portion of said shaft; and c) a top layer, said top layer having a permittivity to fluids, and wherein said top layer is attached to a plurality of said compression elements at their respective said tips wherein said base layer, top layer and compression elements are constructed and arranged such that said laminate has a transmissivity of at least $10^{-3}$ $M^2$ $sec^{-1}$ of aqueous liquid at a normal load of at least 100 PSF (pounds/$ft^2$) sustainable for at least 100 hours.

2. The laminate of claim 1, wherein said compression elements are contiguous with said top surface of said base layer.

3. The laminate of claim 1, wherein said compression elements are provided in shapes, and said shapes are selected from one or more of spikes, cones, spindles, convolutions, bubbles, circular cylinders, ovoid cylinders, flat-faceted pyramids, arcuate-faceted pyramids, volcano-shaped columns, mushroom-shaped columns, tubes, sphere-topped shafts, and peduncles.

4. The laminate of claim 1, wherein said tips of said compression elements are provided with one or more flattened facets adapted and arranged to provide attachment surfaces for said upper layer.

5. The laminate of claim 1, wherein said compression elements define voids between said top surface of said base layer and said top layer.

6. The laminate of claim 1, wherein said base layer is impermeable to fluids.

7. The laminate of claim 1, wherein voids are provided in said bottom surface of said base layer, said voids being adapted and arranged to correspond in position to said compression elements extending from said upper surface of said base layer.

8. The laminate of claim 1, wherein said top layer comprises one or more of membranes, grids and geotextiles.

9. The laminate of claim 1, wherein said top layer is attached to at least 25% of said tips of said plurality of compression elements.

10. The laminate of claim 1, wherein said top layer is attached to at least 50% of said tips of said plurality of compression elements.

11. The laminate of claim 1, wherein said top layer is attached to at least 80% of said tips of said plurality of compression elements.

12. The laminate of claim 1, wherein said top layer is attached to at least 90% of said tips of said plurality of compression elements.

13. The laminate of claim 1, wherein said top layer is attached to at least 95% of said tips of said plurality of compression elements.

14. The laminate of claim 1, wherein said top layer is attached to said tips of said plurality of compression elements with a bond strength of at least 0.10 lbs/square inch of attachment surface.

15. The laminate of claim 1, wherein the ratio of said shaft length to said neck diameter of said plurality of compression elements is at least 2.0-1.0.

16. The laminate of claim 1, wherein the ratio of said shaft length to said neck diameter of said plurality of compression elements is at least 3.0-1.0.

17. The laminate of claim 1, wherein the ratio of said shaft length to said neck diameter of said plurality of compression elements is at least 4.0-1.0.

18. The laminate of claim 1, wherein the ratio of said shaft length to said neck diameter of said plurality of compression elements is at least 5.0-1.0.

19. The laminate of claim 15, wherein said neck diameter is at least 0.5 mm.

20. The laminate of claim 11, wherein said neck diameter is at least 2.0 mm.

21. The laminate of claim 11, wherein said neck diameter is at least 6.0 mm.

22. The laminate of claim 11, wherein said neck diameter is at least 15.0 mm.

23. The laminate of claim 11, wherein said neck diameter is at least 20.0 mm.

24. The laminate of claim 11, wherein said neck diameter is at least 25.0 mm.

25. The laminate of claim 1, wherein said plurality of compression elements are provided on said base layer in a density sufficient to meet desired performance specifications for an intended installation.

26. The laminate of claim 1, wherein said plurality of compression elements are provided on said base layer in a density of at least 1.0 per square inch.

27. The laminate of claim 1, wherein said plurality of compression elements are provided on said base layer in a density of at least 2.0 per square inch.

28. The laminate of claim 1, wherein said plurality of compression elements are provided on said base layer in a density of at least 3.0 per square inch.

29. The laminate of claim 1, wherein said plurality of compression elements are provided on said base layer in a density of at least 4.0 per square inch.

30. The laminate of claim 1, wherein said plurality of compression elements are provided on said base layer in a density of at least 10.0 per square inch.

31. The laminate of claim 1, wherein the percent ratio of the total cross-sectional area of said neck diameters is at least 5% of the area of the bottom layer to which they are attached.

32. The laminate of claim 1, wherein the percent ratio of the total cross-sectional area of said neck diameters is at least 10% of the area of the bottom layer to which they are attached.

33. The laminate of claim 1, wherein the percent ratio of the total cross-sectional area of said neck diameters is at least 15% of the area of the bottom layer to which they are attached.

34. The laminate of claim 1, wherein the percent ratio of the total cross-sectional area of said neck diameters is at least 20% of the area of the bottom layer to which they are attached.

35. The laminate of claim 1, wherein the percent ratio of the total cross-sectional area of said neck diameters is at least 25% of the area of the bottom layer to which they are attached.

36. The laminate of claim 1, wherein the percent ratio of the total cross-sectional area of said neck diameters is at least 50% of the area of the bottom layer to which they are attached.

37. The laminate of claim 5, wherein the average width of said voids defined between said compression elements, said base layer and said top layer is less than the width of said base of said compression elements.

38. The laminate of claim 5, wherein the average width of said voids defined between said compression elements, said base layer and said top layer is more than the width of said base of said compression elements.

39. The laminate of claim 5, wherein the average height of said compression elements is less than the average width of said base of said compression elements.

40. The laminate of claim 5, wherein the average height of said compression elements is more than the average width of said base of said compression elements.

41. The laminate of claim 1, wherein said compression elements are evenly spaced on said base layer in a grid-like pattern.

42. The laminate of claim 1, formed of one or more thermoplastics.

43. The laminate of claim 1, wherein said one or more thermoplastics are selected from the group consisting of polyethylene, high density polyethylene ("HDPE"), polypropylene, glass-filled plastics, and ABS.

44. The laminate of claim 1, wherein said base layer, top layer and compression elements are constructed and arranged such that said laminate has a transmissivity of at least $10^{-3}$ $M^2$ $sec^{-1}$ of aqueous liquid at a normal load of at least 1,000 PSF (pounds/$ft^2$) sustainable for at least 100 hours.

45. The laminate of claim 1, wherein said base layer, top layer and compression elements are constructed and arranged such that said laminate has a transmissivity of at least $10^{-3}$ $M^2$ $sec^{-1}$ of aqueous liquid at a normal load of at least 10,000 PSF (pounds/$ft^2$) sustainable for at least 100 hours.

46. The laminate of claim 1, wherein said base layer, top layer and compression elements are constructed and arranged such that said laminate has a transmissivity of at least $10^{-3}$ $M^2$ $sec^{-1}$ of aqueous liquid at a normal load of at least 15,000 PSF (pounds/$ft^2$) sustainable for at least 100 hours.

47. The laminate of claim 1, wherein said base layer, top layer and compression elements are constructed and arranged such that said laminate has a transmissivity of at least $10^{-3}$ $M^2$ $sec^{-1}$ of aqueous liquid at a normal load of at least 20,000 PSF (pounds/$ft^2$) sustainable for at least 100 hours.

48. A method for forming void-maintaining laminates to meet desired specifications, comprising the acts or steps of:

A) providing a base layer, said base layer comprising a plurality of compression elements, said compression elements being contiguous with said base layer, and said compression elements comprising compression element tips which are i) located distal to said base layer, and ii) disposed substantially perpendicular to said base layer;

B) providing a fluid-permeable geotextile top layer, wherein said top layer is attached to a plurality of said compression element tips, wherein said base layer, top layer and compression elements are constructed and arranged such that said laminate achieves said desired specifications, and wherein said desired specifications comprise a transmissivity of at least $10^{-3}$ $M^2$ $sec^{-1}$ of aqueous liquid at a normal load of at least 100 PSF (pounds/$ft^2$) sustainable for at least 100 hours.

49. The method of claim 48, wherein said compression elements are provided in shapes, and said shapes are selected from one or more of spikes, cones, spindles, convolutions, bubbles, circular cylinders, ovoid cylinders, flat-faceted pyramids, arcuate-faceted pyramids, volcano-shaped columns, mushroom-shaped columns, tubes, sphere-topped shafts, and peduncles.

50. The method of claim 48, wherein said tips of said compression elements are provided with one or more flattened facets adapted and arranged to provide attachment surfaces for said upper layer.

51. The method of claim 48, wherein said compression elements define voids between said top surface of said base layer and said top layer.

52. The method of claim 48, wherein said base layer is impermeable to fluids.

53. The method of claim 48, wherein voids are provided in said bottom surface of said base layer, said voids being adapted and arranged to correspond in position to said compression elements extending from said upper surface of said base layer.

54. The method of claim 48, wherein said top layer comprises one or more of membranes, grids and geotextiles.

55. The method of claim 48, wherein said top layer is attached to at least 60% of said tips of said plurality of compression elements.

56. The method of claim 48, wherein said top layer is attached to at least 95% of said tips of said plurality of compression elements.

57. The method of claim 48, wherein said top layer is attached to said tips of said plurality of compression elements with a bond strength of at least 0.10 lbs/square inch of attachment surface.

58. The method of claim 48, wherein the ratio of said shaft length to said neck diameter of said plurality of compression elements is at least 0.5-1.0.

59. The method of claim 48 wherein the ratio of said shaft length to said neck diameter of said plurality of compression elements is at least 2.0-1.0.

60. The method of claim 48, wherein the ratio of said shaft length to said neck diameter of said plurality of compression elements is at least 4.0-1.0.

61. The method of claim 48, wherein said neck diameter is at least 0.5 mm.

62. The method of claim 48, wherein said neck diameter is at least 3.0 mm.

63. The method of claim 48, wherein said neck diameter is at least 8.0 mm.

64. The method of claim 48 wherein said neck diameter is at least 20.0 mm.

65. The method of claim 48, wherein said neck diameter is at least 25.0 mm.

66. The method of claim 48, wherein said plurality of compression elements are provided on said base layer in a density sufficient to meet desired performance specifications for an intended installation.

67. The method of claim 48, wherein said plurality of compression elements are provided on said base layer in a density of at least 1.0 per square inch.

68. The method of claim 48, wherein said plurality of compression elements are provided on said base layer in a density of at least 4.0 per square inch.

69. The method of claim 48, wherein said plurality of compression elements are provided on said base layer in a density of at least 10.0 per square inch.

70. The method of claim 48, wherein the percent ratio of the total cross-sectional area of said neck diameters is at least 5% of the area of the bottom layer to which they are attached.

71. The method of claim 48, wherein the percent ratio of the total cross-sectional area of said neck diameters is at least 20% of the area of the bottom layer to which they are attached.

72. The method of claim 48, wherein the percent ratio of the total cross-sectional area of said neck diameters is at least 25% of the area of the bottom layer to which they are attached.

73. The method of claim 48, wherein said compression elements are evenly spaced on said base layer in a grid-like pattern.

74. The method of claim 48, formed of one or more thermoplastics, and wherein said one or more thermoplastics are selected from the group consisting of polyethylene, high density polyethylene ("HDPE"), polypropylene, glass-filled plastics, and ABS.

75. The method of claim 48, wherein said base layer, top layer and compression elements are constructed and arranged such that said laminate has a transmissivity of at least $10^{-3}$ $M^2$ $sec^{-1}$ of aqueous liquid at a normal load of at least 1,000 PSF (pounds/$ft^2$) sustainable for at least 100 hours.

76. The method of claim 48, wherein said base layer, top layer and compression elements are constructed and arranged such that said laminate has a transmissivity of at least $10^{-3}$ $M^2$ $sec^{-1}$ of aqueous liquid at a normal load of at least 10,000 PSF (pounds/$ft^2$) sustainable for at least 100 hours.

77. The method of claim 48, wherein said base layer, top layer and compression elements are constructed and arranged such that said laminate has a transmissivity of at least $10^{-3}$ $M^2$ $sec^{-1}$ of aqueous liquid at a normal load of at least 15,000 PSF (pounds/$ft^2$) sustainable for at least 100 hours.

78. The method of claim 48, wherein said base layer, top layer and compression elements are constructed and arranged such that said laminate has a transmissivity of at least $10^{-3}$ $M^2$ $sec^{-1}$ of aqueous liquid at a normal load of at least 20,000 PSF (pounds/$ft^2$) sustainable for at least 100 hours.

* * * * *